US005272720A

United States Patent [19]

Cignetti et al.

[11] Patent Number: 5,272,720

[45] Date of Patent: Dec. 21, 1993

[54] INDUCTION HEATING APPARATUS AND METHOD

[75] Inventors: Nicolas P. Cignetti, Canton, Ohio; Richard U. Swaney, Tarentum, Pa.; John H. Mortimer, Medford, N.J.

[73] Assignee: Inductotherm Corp., Rancocas, N.J.

[21] Appl. No.: 532,010

[22] Filed: Jun. 1, 1990

Related U.S. Application Data

[63] Continuation-in-part of Ser. No. 473,000, Jan. 31, 1990.

[51] Int. Cl.[5] ..... H05B 6/22

[52] U.S. Cl. ..... 373/155; 373/151; 373/152; 373/156; 373/157; 373/159; 373/163; 373/164

[58] Field of Search ..... 219/10.491, 427, 10.67, 219/10.79, 10.51; 373/155, 138, 139, 142, 140, 144, 146, 151, 152, 154, 156, 157, 160, 164, 165, 119, 159, 162; 75/10.14, 707

[56] References Cited

U.S. PATENT DOCUMENTS

| | | | |
|---|---|---|---|
| 1,235,630 | 8/1917 | Wyatt | 373/144 |
| 1,682,388 | 8/1928 | Lincoln | 373/151 |
| 1,743,956 | 1/1930 | Bunet | 373/159 |
| 1,795,842 | 3/1931 | Davis | 373/155 |
| 1,834,725 | 12/1931 | Northrup | 373/150 |
| 1,879,360 | 9/1932 | Linnhoff | 373/151 |
| 2,253,421 | 8/1941 | Maré | 373/142 |
| 2,969,411 | 1/1961 | Gibbs | 373/156 |
| 3,154,404 | 10/1964 | Lorenz | 75/10.17 |
| 3,314,670 | 4/1967 | Kennedy | 373/146 |
| 3,320,348 | 5/1967 | Seulen et al. | 373/164 |
| 3,335,212 | 8/1967 | Seulen et al. | 373/164 |
| 3,461,215 | 8/1969 | Reboux | 373/158 |
| 3,700,779 | 10/1972 | Pomey | 373/140 |
| 3,704,336 | 11/1972 | Synnestvedt | 373/153 |
| 3,709,678 | 1/1973 | Helary et al. | 75/10 R |
| 4,336,411 | 6/1982 | Hanas et al. | 373/85 |
| 4,410,796 | 10/1983 | Wilsey | 219/553 |
| 4,411,412 | 10/1983 | Lechevallier | 266/242 |
| 4,446,563 | 5/1984 | Willay | 373/157 |
| 4,715,041 | 12/1987 | Bühler et al. | 373/72 |

FOREIGN PATENT DOCUMENTS 1208451 5/1961 Fed. Rep. of Germany .

OTHER PUBLICATIONS

Asea Metallurgy, Asea.
Detem Plant and Process Description.

*Primary Examiner*—Bruce A. Reynolds
*Assistant Examiner*—Tu Hoang
*Attorney, Agent, or Firm*—Seidel, Gonda, Lavorgna & Monaco

[57] ABSTRACT

Induction heating vessels and methods are disclosed. One embodiment of an induction heating vessel is a bottom pouring vessel with a crucible for containing a molten metal to be heated and having an outlet in the bottom. A metallic shell with integral current limiters surrounds the crucible. A stopper is provided for selectably controlling the flow of molten metal through the outlet. A method of preheating an induction heating vessel comprises placing a susceptor inside the vessel prior to charging the vessel with material to be heated and inductively heating the susceptor by an induction coil.

12 Claims, 12 Drawing Sheets

FIG. 14
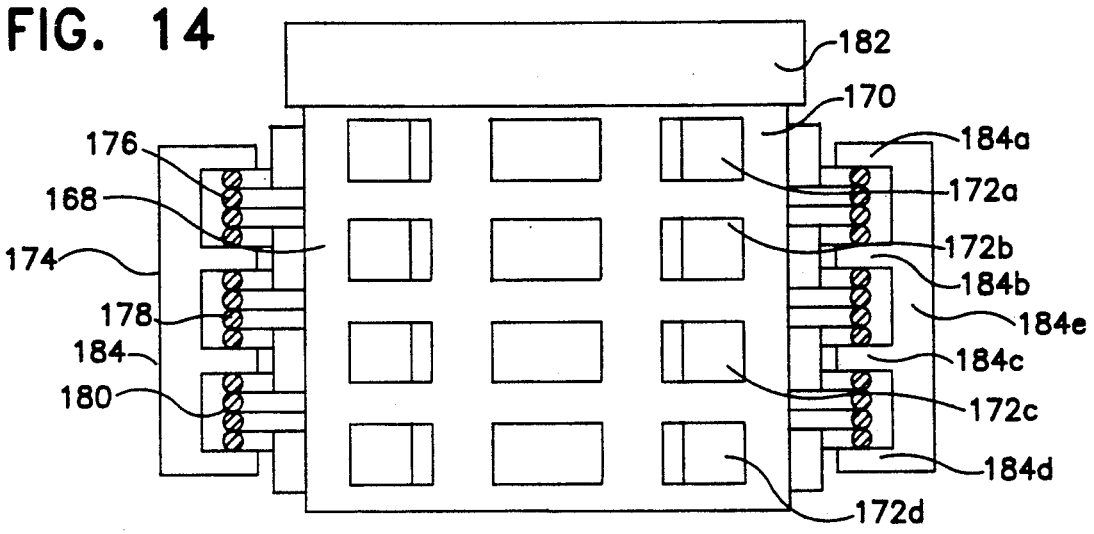
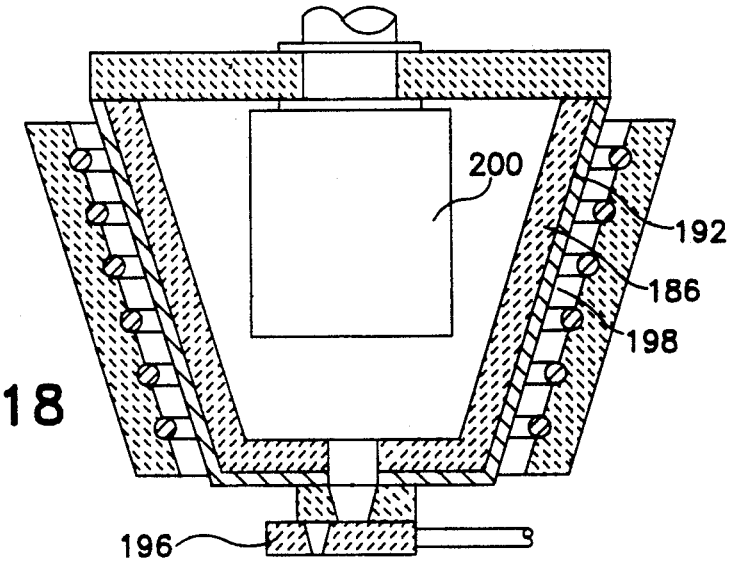
FIG. 18
FIG. 19
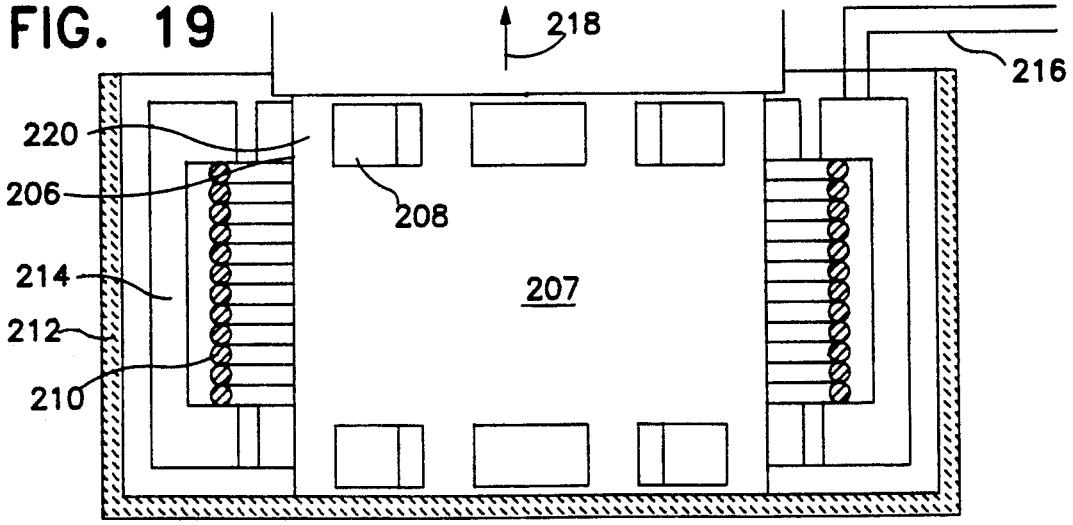

INDUCTION HEATING APPARATUS AND METHOD

This is a continuation-in-part of co-pending application Ser. No. 07/473,000 filed on Jan. 31, 1990.

FIELD OF THE INVENTION

This invention relates in its broadest aspects to structure and method for rendering a metallic object substantially transparent to an applied alternating magnetic field. The invention finds particular utility with respect to metal-reinforced heating vessels for coreless induction furnaces, although the invention is not so limited.

BACKGROUND OF THE INVENTION

Coreless induction furnaces for melting or otherwise heating metal by inducing eddy currents to flow within the metal are well known. (As used in this disclosure, the term "heating" is used broadly to encompass not only raising the temperature of a material without causing the material to change state, but also melting, wherein the temperature of a material is raised sufficiently to cause it to change state.) Typically, metal to be heated is contained in a vessel, usual but not always a crucible. Eddy currents are electromagnetically induced in the metal by an induction coil surrounding the vessel. The eddy currents cause power to be dissipated in the metal, thereby increasing its temperature. In effect, the metal serves as its own heat source. The eddy currents are induced in the metal when alternating current is passed through the induction coil to generate an alternating magnetic field, or induction field. Depending upon the frequency of the alternating current in the induction coil, and on other design considerations, an induction furnace may be used for either heating or physically agitating ("stirring") a quantity of molten metal, and sometimes both.

The heating vessel must meet certain stringent physical standards. It must have a sufficiently high melting point so that it will not be melted by the heat of the metal, it must have a high strength to hold the weight of the metal, and it must not interfere with the passage of magnetic flux from the induction coil through and around the metal. Very often, these requirements of high melting point, strength, and lack of interference with the applied magnetic induction field are at cross-purposes from a design standpoint.

The present invention optimizes the competing design criteria, enables induction heating vessels to be made larger and stronger than previous designs, and offers dramatic improvements in efficiency. The present invention is particularly-well suited for removable heating vessels for coreless induction furnaces. Removable crucible induction furnaces have been known since at least the early part of this century. See, e.g., U.S. Pat. No. 1,023,309 to Helberger, which discloses a ceramic refractory crucible which is partially sintered in place and which is pushed out of the induction coil by a hydraulic ram. In practical terms, however, the utility of a crucible such as that disclosed by Helberger is limited by the use of ceramic alone for the crucible. Ceramic, as is well known, is brittle and subject to stress cracking. Breakage of the ceramic crucible could lead to "run out" of molten metal from the crucible, posing a severe safety hazard to operating personnel and to equipment, as well as leading to loss of the metal charge. Thus, ceramic crucibles tend to be relatively small and limited to small quantities of metal.

One way of strengthening a ceramic crucible is to surround it by a continuous metallic jacket, or shell. Metals are generally less brittle and have higher yield strengths than ceramics. The shell material is typically steel. However, since steel and many other useful metals are either electrically conductive, magnetic, or greatly weakened when heated, steel-jacketed ceramic crucibles do not offer much of an improvement over ceramic crucibles alone since the magnetic field generated by the induction coil will heat the shell as well as the molten metal in the crucible, thus rendering the vessel either useless or unsafe.

Where metal-jacketed ceramic crucibles have been used in induction furnaces, their use has generally been restricted to induction stirring, not induction heating. For example, U.S. Pat. No. 3,314,670 to Kennedy describes a vessel having a one-piece, electrically continuous outer shell of austenitic stainless steel with a refractory lining. The steel must be specially selected to have very specific electrical and magnetic properties. The Kennedy vessel is capable of use only within a frequency range of 0.1 Hz to 60 hz (column 2, line 59). Further, the Kennedy vessel is limited to stirring, and the Kennedy patent states that stirring may take place effectively only within a narrow range of parameters, taking into account the competing requirements of temperature range, stirring forces, strength, and economics. Kennedy thus recognizes that his vessel is not usable for induction melting.

Other attempts at developing usable metal-jacketed ceramic crucibles involve the selection of exotic materials. For example, U.S. Pat. No. 4,446,563 to Willay discloses a composite vessel with an inner container made of vitreous carbon and an outer container made of platinum. Clearly, however, such exotic designs are extremely impractical and are not cost effective for most applications.

There thus exists a definite need for a metaljacketed induction heating vessel that overcomes the drawbacks of the prior art. The present invention provides such a vessel by providing a method by which a metallic shell can be rendered substantially transparent to an applied induction field and by which eddy currents induced in the shell are greatly reduced, thus reducing heating in the shell. A metal-jacketed induction heating vessel employing the principles of the present invention does not rely on exotic materials, nor is it limited to only inductive stirring of molten metals. A metal-jacketed induction heating vessel according to the present invention is, in contrast to prior vessels, able to handle large quantities of metal, with excellent yield strengths at operating temperatures. At the same time, a vessel according to the present invention allows most of the electromagnetic field developed by the induction coil to couple with the metal to be melted, with only a small amount coupling to the metal jacket. This also is a substantial improvement over prior metal-jacketed crucibles, in which a great deal of energy was lost in coupling between the induction coil and the metal jacket itself.

Moreover, the present invention is not limited to ceramic-lined vessels for coreless induction furnaces. The present invention includes metal-jacketed induction heating vessels which have an inductively heatable susceptor, such as a graphite susceptor, in which non-conductive materials may be heated indirectly by inductively heating the susceptor.

These and other advantages of the present invention will become apparent from the following description.

SUMMARY OF THE INVENTION

In its broad aspect, the present invention is directed to a method of rendering a metallic object substantially transparent to an applied alternating magnetic field, and comprises providing the object with discrete physically integral but electrically isolated regions for limiting the flow of electromagnetically induced electric currents in the object at locations to be rendered transparent.

In a somewhat narrower aspect, the invention is directed to a method of mechanically reinforcing an induction heating vessel. In this aspect of the invention, the method comprises providing the vessel with a metallic shell which is substantially continuous and which substantially conforms to the shape of the vessel, and providing the shell with discrete physically integral but electrically isolated regions at preselected locations in the shell, whereby the shell is rendered substantially transparent to the induction field at the preselected locations.

In its structural aspects, the invention is broadly directed to a metallic shell for an induction heating vessel. The shell is substantially continuous and substantially conforms to the shape of the vessel. The shell has means integral with it for limiting the flow of induced electric current in it and is substantially transparent to an applied induction field.

The invention is also directed to an induction heating vessel which comprises means for holding material to be heated, a substantially continuous metallic shell surrounding and generally conforming to the holding means, the shell having means integral with it for limiting the flow of induced electric currents in the shell.

The invention further comprises an induction heating apparatus comprising means for holding material to be heated, induction coil means surrounding the holding means, and metallic shell means between the holding means and the coil means for mechanically reinforcing the holding means. The shell has integral current limiting means for limiting electric currents induced in the shell means by the coil means and for causing the shell means to be substantially transparent to the electromagnetic induction field.

In one of its structural aspects, the present invention is directed to an induction melting vessel comprising a refractory crucible having an open top end and a closed bottom end, with a substantially continuous side wall between the top and bottom ends. A substantially continuous metallic shell is provided surrounding and generally conforming to the side wall, and extending for at least a majority of the height of the side wall from the bottom end to the top end. The shell thus has a bottom end corresponding to the bottom end of the crucible and a top end corresponding to the top end of the crucible. A portion of the shell adjacent its top end and a portion of the shell adjacent its bottom end each have discrete physically integral but electrically isolated regions therein for limiting the flow of electric current in the shell.

In one embodiment, the regions are defined by a plurality of slits through the shell which extend from the top and bottom ends of the shell toward the respective opposite ends. The slits are of a length not exceeding half the distance to the respective opposite end.

In an alternate embodiment, the regions are defined by a plurality of electrically isolated laminations arranged generally perpendicularly to the shell side wall. The laminations may be either in the form of a physically continuous closed path, or arranged in discrete groups.

In another embodiment, the present invention is directed to a bottom pouring induction heating vessel comprising holding means for containing a material to be heated having a substantially continuous side wall and a bottom portion having outlet means located in the bottom portion of the vessel. Stopper means selectably control the flow of material through the outlet means. The holding means has integral means for limiting the flow of induced electrical currents in the holding means.

Another embodiment places a susceptor means inside the holding means prior to the insertion of the material to be melted for inductively preheating the vessel by an induction coil.

An additional embodiment is directed to an induction vessel for multi-phase stirring comprising holding means for containing a material to be melted having a substantially continuous side wall electrically insulated from a bottom wall and having current limiting means located in its side wall. The vessel is surrounded by a plurality of coils adjacent one another and which are energized to create a multi-phase magnetic induction field. Shunt means surround the circumference of each coil and direct the flow of the flux.

Another embodiment is directed to an improved positive pressurized pouring ladle. The ladle comprises a crucible having an upper portion and a lower portion wherein the lower portion is surrounded by a metal shell having eddy current limiting means to control the temperature of the molten metal. The upper portion has a substantially continuous side wall and an upwardly angled inlet spout located on one side of the wall and an upwardly angled outlet spout located on the opposite side of the wall.

One of the embodiments is directed to a method of treating alloys which place an induction vessel in association with an induction coil inside a chamber. The induction vessel includes current limiting means which are permeable to a treating gas. The vessel is charged with an alloy to be treated and the induction coil is energized to inductively heat the alloy. A treating gas, for example argon, is pumped into the tank at atmospheric pressure and surrounds the vessel. A vacuum is applied to the interior of the induction vessel, creating a pressure differential between the interior and exterior of the vessel. The vacuum draws the gas into the vessel through the current limiting means to treat the alloy in the vessel.

When used in the context of induction heating, the present invention enables highly efficient coupling of the field developed by the induction coil with the material to be heated (e.g., a metal charge or a graphite susceptor) and minimizes heating of the shell, which in turn allows the use of commercially available engineering metals for the shell and provides the benefits of a metal-jacketed crucible without the drawbacks.

Of course, although the invention is described in relation to induction heating, it should be understood that the present invention is applicable wherever it is desired to render a metallic object substantially transparent to an applied magnetic field.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 14 is a sectional view illustrating the vessel of the invention adapted to be used in a multi-phase coil assembly. A three-phase embodiment is illustrated.

FIG. 18 is a sectional view illustrating an additional embodiment of the induction heating vessel in FIG. 15.

FIG. 19 illustrates the induction heating vessel of the present invention used in a treatment process.

DESCRIPTION OF THE INVENTION

Figure 1:
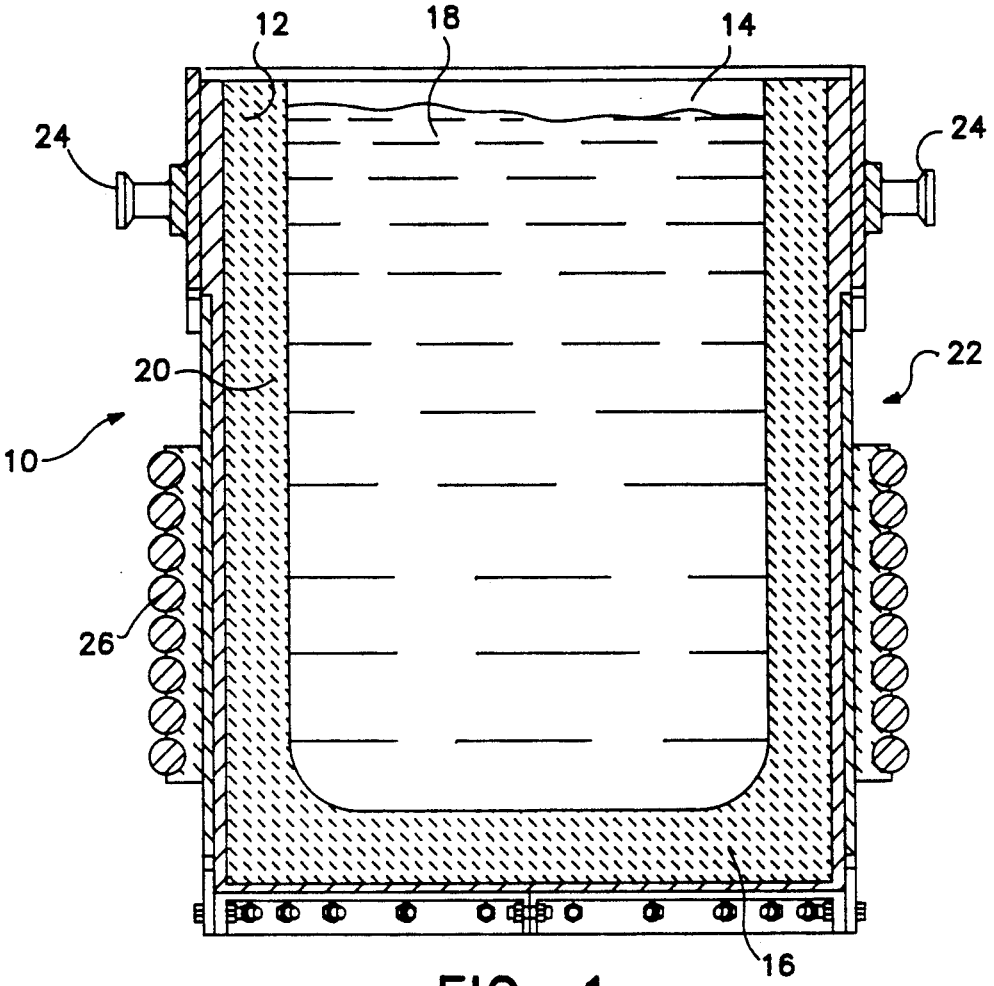
FIG. 1 is a longitudinal sectional view of an induction heating vessel according the present invention.

Referring now to the drawings, wherein like numerals indicate like elements, there is shown in FIGS. 1 through 4 one embodiment of an induction heating vessel according to the present invention. (While the invention is described and illustrated using an induction heating vessel, it should be remembered that the invention is not so limited.) The entire vessel is indicated by reference numeral 10. Vessel 10 comprises a crucible 12, which may be a refractory ceramic or an electrically conductive electromagnetic susceptor, such as graphite. Crucible 12 has an open top end 14 and a closed bottom end 16 and, in known manner, contains a charge 18 of metal being melted. As shown in the drawings, crucible 12 and, consequently, vessel 10, are substantially cylindrical in shape. Although the present invention will be described with reference to a substantially cylindrical crucible, it should be understood that the precise shape of the crucible is not crucial to the present invention. Thus, although it is generally easier to manufacture a cylindrical vessel, the vessel may be rectangular, or in the shape of an oblate spheroid, for example, without departing from the scope of the invention. Likewise, although crucible 12 is illustrated having a closed bottom end, the crucible may have an open bottom, and can be any suitable means for holding material to be inductively heated. Thus, without departing from the scope of the invention, crucible 12 could just as easily be a casting ladle, launder, runner, sprue or the like.

Crucible 12 also has a side wall 20 between the top and bottom ends 14 and 16, respectively, of crucible 12. Surrounding and generally conforming to crucible side wall 20 is a metallic shell designated generally by reference numeral 22. (It will be noted that, except for FIG. 1, crucible 12 has been omitted in order to more clearly show the structure of shell 22.) Shell 22 is preferably, but not necessarily, fitted with a pair of diametrically opposite lugs 24 adjacent the top end of crucible 12 Lugs 24 permit vessel 10 to be lowered into or lifted out of the interior of induction coil 26. Induction coil 26 is a conventional induction coil through which an alternating current flows which, in known manner, generates an alternating magnetic field, or induction field. The induction field, in turn, couples with the metal 18 and heats it. As those skilled in the art will recognize, the flux lines of the induction field from coil 26 will enter and leave crucible 12 adjacent the top and bottom ends of shell 22.

Figure 4:
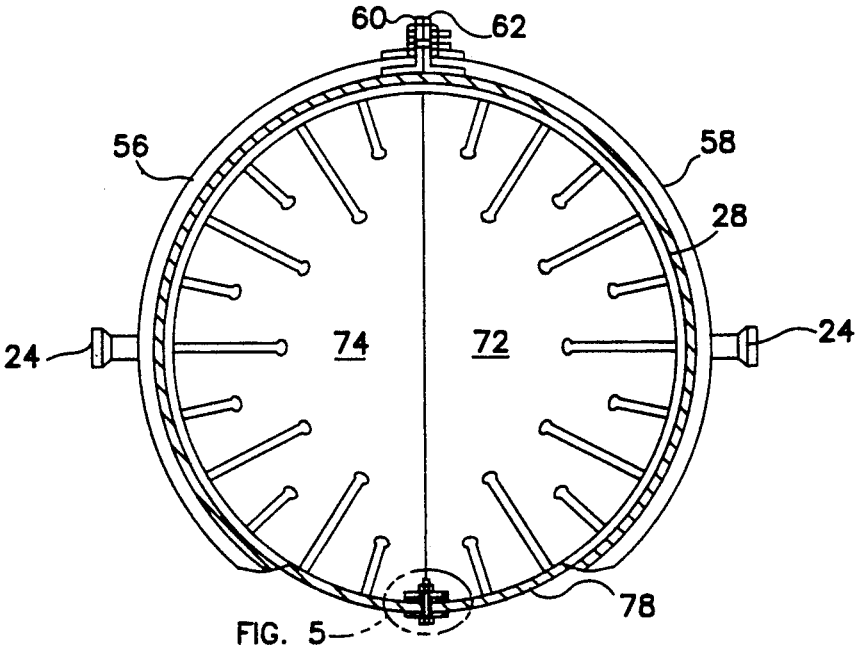
FIG. 4 is a transverse sectional view of the vessel of FIG. 2, taken along the lines 4—4 in FIG. 2.
Figure 2:
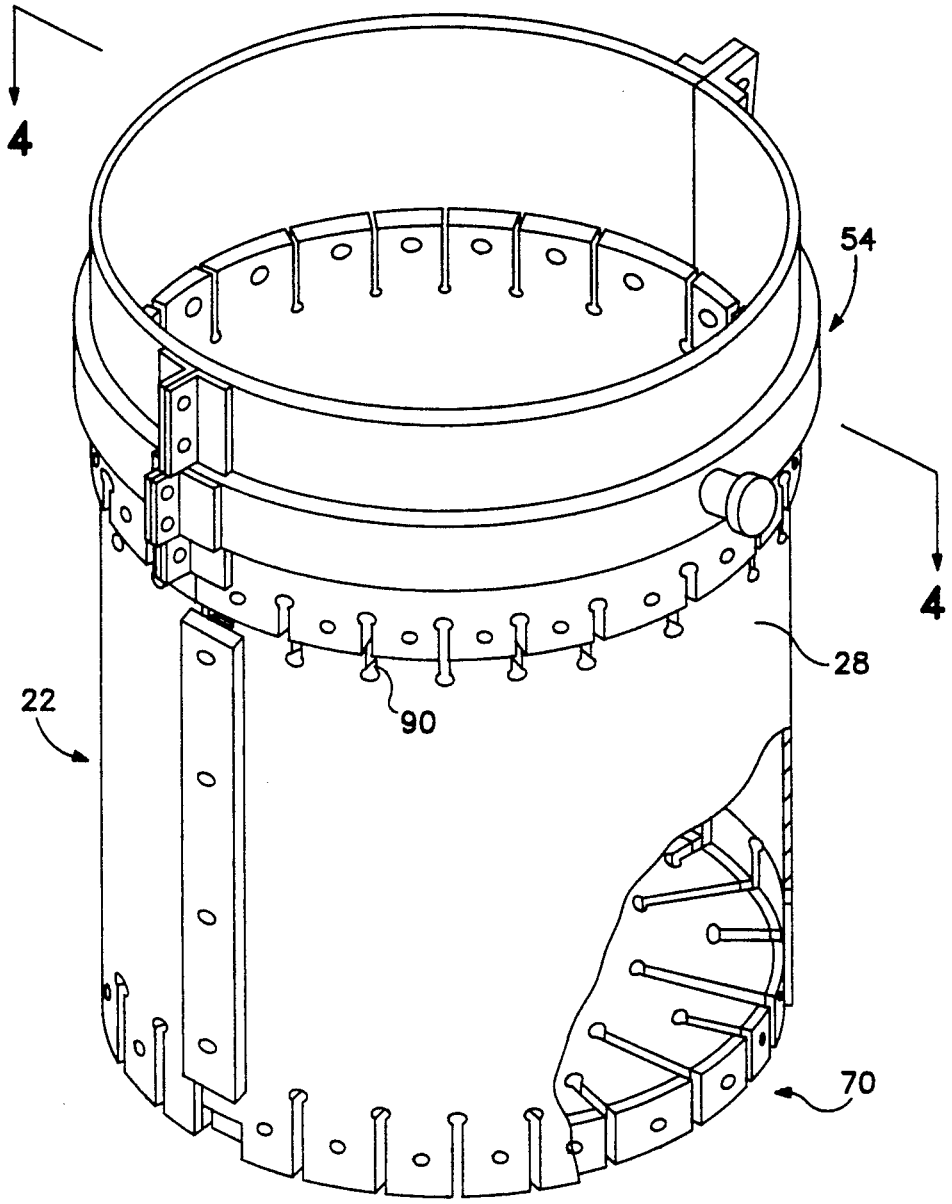
FIG. 2 is an isometric view of the vessel of FIG. 1.
Figure 5:
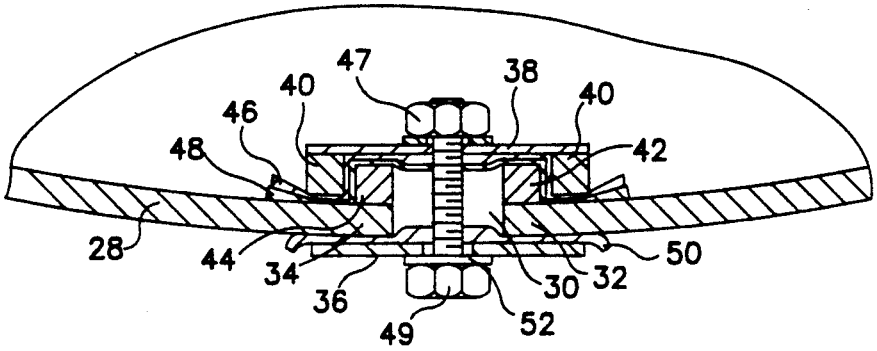
FIG. 5 is an enlarged view of a portion of FIG. 4, showing the interconnection of the various parts of the vessel shell.
Figure 3:
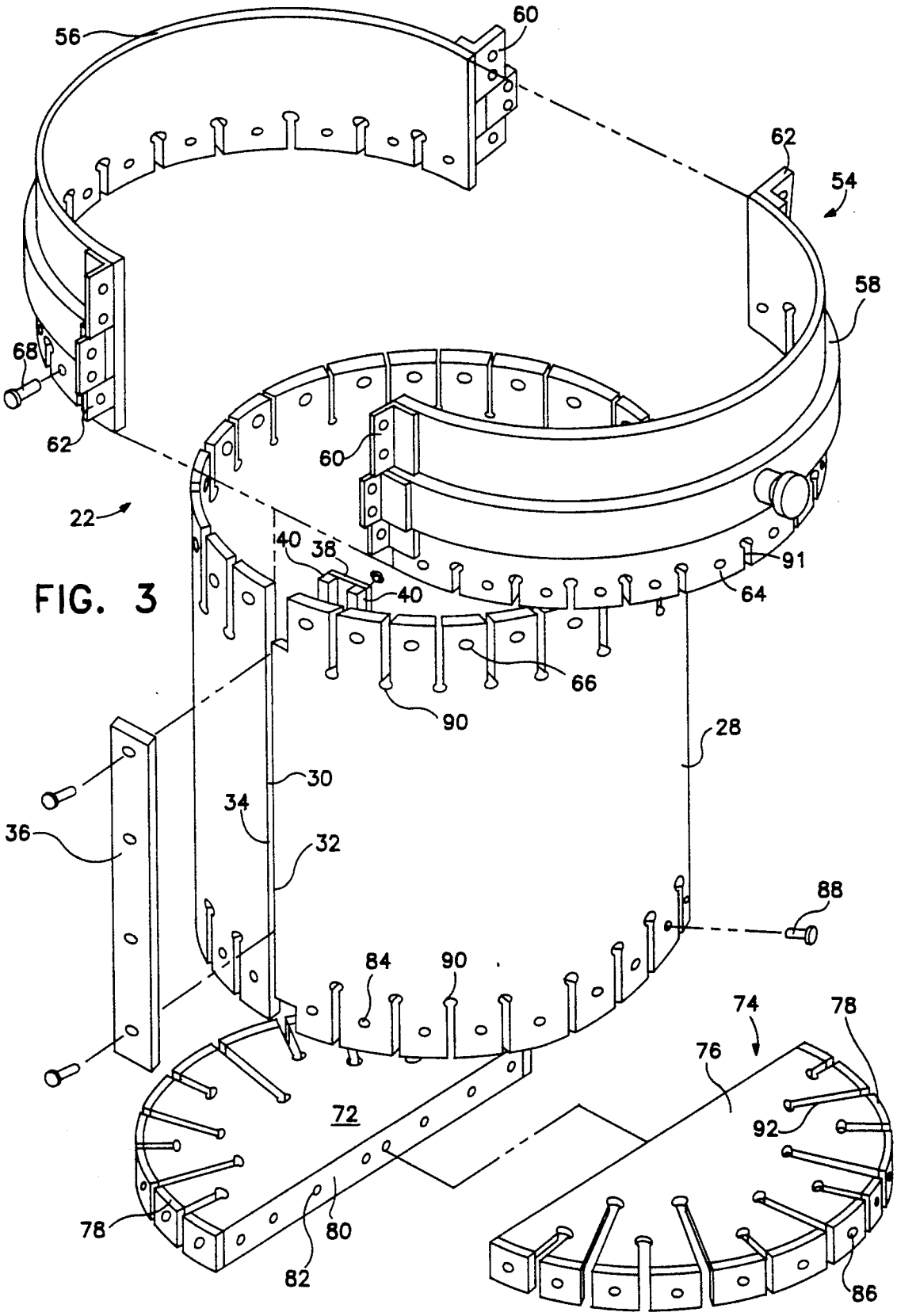
FIG. 3 is an exploded view of the vessel of FIG. 2.

The structure of shell 22 according to a first embodiment of the invention is best illustrated in FIGS. 2 through 4. Shell 22 comprises, at a minimum, a substantially continuous side wall 28 which is preferably a single sheet of a metallic material, such as steel, that wraps around and substantially conforms to crucible 12. Shell side wall 28 is wrapped around crucible 12 and surrounds substantially the entire circumference of crucible 12, with the exception of a small gap 30 between ends 32 and 34 of side wall 28. Gap 30 provides an electrical discontinuity between ends 32 and 34, which serves to limit induced eddy currents in shell side wall 28. Ends 32 and 34 are held in place by retaining plates 36 and 38 which, as more clearly shown in FIG. 5, are electrically insulated from side wall 28 by non-conductive strips 40 Strips 40 also cooperate with corresponding strips 42 and 44 on the inside surface of ends 32 and 34, respectively, of shell 28. Strips 40, 42 and 40, 44 cooperate, when plates 36 and 38 are bolted together, to give side wall 28 added strength and prevent it from "unwrapping" from crucible 12. Retaining plates 36 and 38 are secured by a plurality of fasteners such as nut and bolt arrangement 47, 49. It should be noted that, in order to maintain electrical isolation between ends 32 and 34 of side wall 28, insulating strips and insulating washers 46, 48, 50 and 52 are used wherever metal parts of the shell might come into contact. Thus, as can be seen in FIG. 5, while the shell is physically continuous there is no electrically conductive path between ends 32 and 34 of side wall 28.

Side wall 28 may also be fitted with a collar assembly, generally designated by numeral 54. Preferably, although not necessarily, collar assembly 54 comprises two separate halves 56, 58 which are essentially identical and which are bolted together along their edges to form a single unit. For this purpose, each collar half is provided with flanges 60 and 62 by which halves 56, 58 may be bolted or riveted together, in known manner. Although not illustrated in the drawings, it is preferable that collar halves 56, 58 be insulated from one another. For that purpose, an insulating strip is placed between flanges 60 and 62 before halves 56 and 58 are joined together.

Collar assembly 54 is provided with a plurality of circular openings 64 along one edge which mate with corresponding circular openings 66 along one edge of shell side wall 28 so that collar 54 may be joined to shell 28, such as by bolts or rivets 68. Again, although not shown in the drawings, it is preferable that collar assembly 54 be electrically insulated from shell side wall 28. For that purpose, a strip or band of insulating material may be placed between collar assembly 54 and shell side wall 28.

Shell 22 also preferably includes a bottom, designated generally by reference numeral 70. Preferably, bottom 70 comprises two halves 72 and 74. Each half is substantially identical to the other and comprises a support plate 76 and a side edge 78 generally perpendicular to plate 76. Each half also comprises a diametric flange 80 which enables it to be joined to its opposite half. For that purpose, a plurality of openings 82 is provided in flange 80 so that halves 72, 74 may be joined together, such as by bolts or rivets. Halves 72 and 74 are preferably electrically insulated from one another. For that purpose, an insulating strip is placed between the flanges 80 of halves 72 and 74 before they are joined together. The bottom 70 is joined to the bottom edge of shell 28 by means of openings 84 and 86 provided adjacent the bottom end of shell side wall 28 and in the side edges 78 of bottom halves 72 and 74, respectively. Bottom 70 is joined to the bottom edge of side wall 28 by fasteners such as bolts or rivets 88. Preferably, an insulating band is placed between bottom 70 and the bottom end of shell side wall 28, so that the bottom 70 is electrically insulated from shell 22.

Preferably, although by no means necessarily, the gap formed by flanges 80 of bottom halves 72 and 74 and one of the gaps formed by flanges 60 and 62 of collar halves 56 and 58 are co-linear with gap 30 in shell 22.

As suggested by FIG. 5, the fasteners used to connect the various parts of shell 22 together are preferably, although not necessarily, electrically insulated by insulating strips and washers, as required, so that the individual parts of shell 22 are electrically isolated from the other parts of shell 22. By electrically isolating the various parts of shell 22 from one another, induced eddy currents in shell 22 are minimized.

Induced eddy currents in shell 22 are primarily minimized by a plurality of discrete physically integral but electrically isolated regions in shell 22. These regions serve to break up and limit the flow of eddy currents induced in the shell by induction coil 26. In the embodiment of the invention illustrated in FIGS. 1 through 4, the regions are defined by a plurality of slits 90 which extend through shell side wall 28 from the top end and the bottom end and extend toward the respective opposite ends of side wall 28. Opposed slits in the top and bottom ends may lie along the same longitudinal line along side wall 28, or may be offset with respect to each other. The length of each slit does not exceed fifty percent of the distance to the opposite end of shell side wall 28 and, preferably, the slits are of such length that the total length of corresponding pairs of opposed slits at the top and bottom edges of shell 28 does not exceed twenty percent of the height of side wall 28. The slits need not be very wide, as long as there is no electrical path across the slits. The slits may remain unfilled so that each slit comprises an air gap, or the slits may be filled with an insulating cement for added shell strength.

Collar assembly 54 is likewise provided with a plurality of slits in its bottom edge. These slits are preferably, although not necessarily, in alignment with slits 90 in the top edge of shell side wall 28. Likewise, the side edges 78 of bottom 70 are provided with a plurality of slits 91 which are preferably, but not necessarily, in alignment with slits 90 in the bottom edge of shell side wall 28. Halves 72 and 74 of bottom 70 are also provided with radially inward slits 92, which are preferably, but need not be, in alignment with the slits in side edge 78. Preferably, although not necessarily, slits 92 are alternately longer and shorter, to better minimize induced eddy currents in bottom 70. Preferably, the maximum length of slits 92 is not greater than forty percent of the radius of bottom 70.

Figure 6:
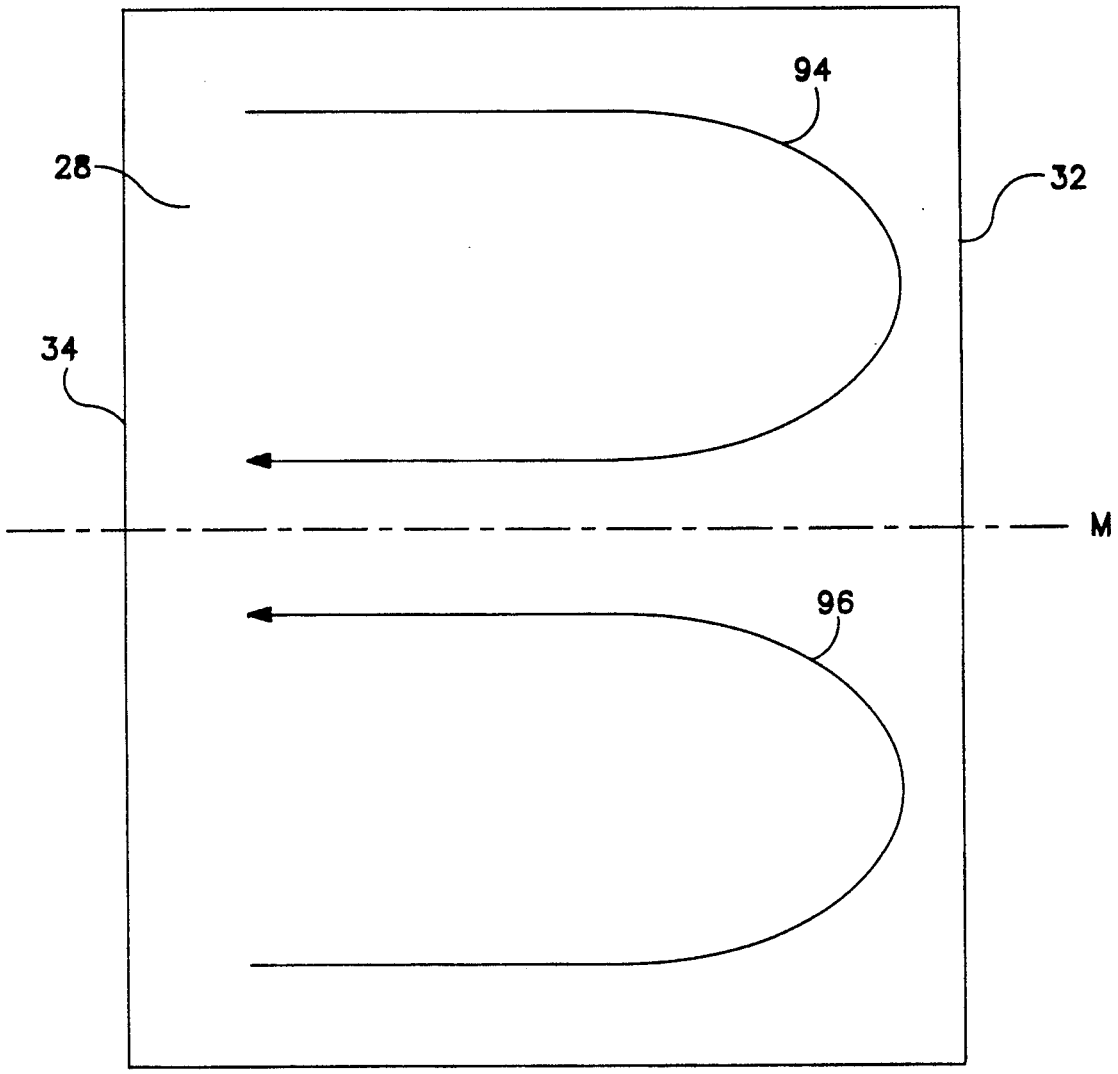
FIGS. 6 and 7 illustrate the flow of induced eddy currents in a metal object without and with the features of the invention, respectively.
Figure 7:
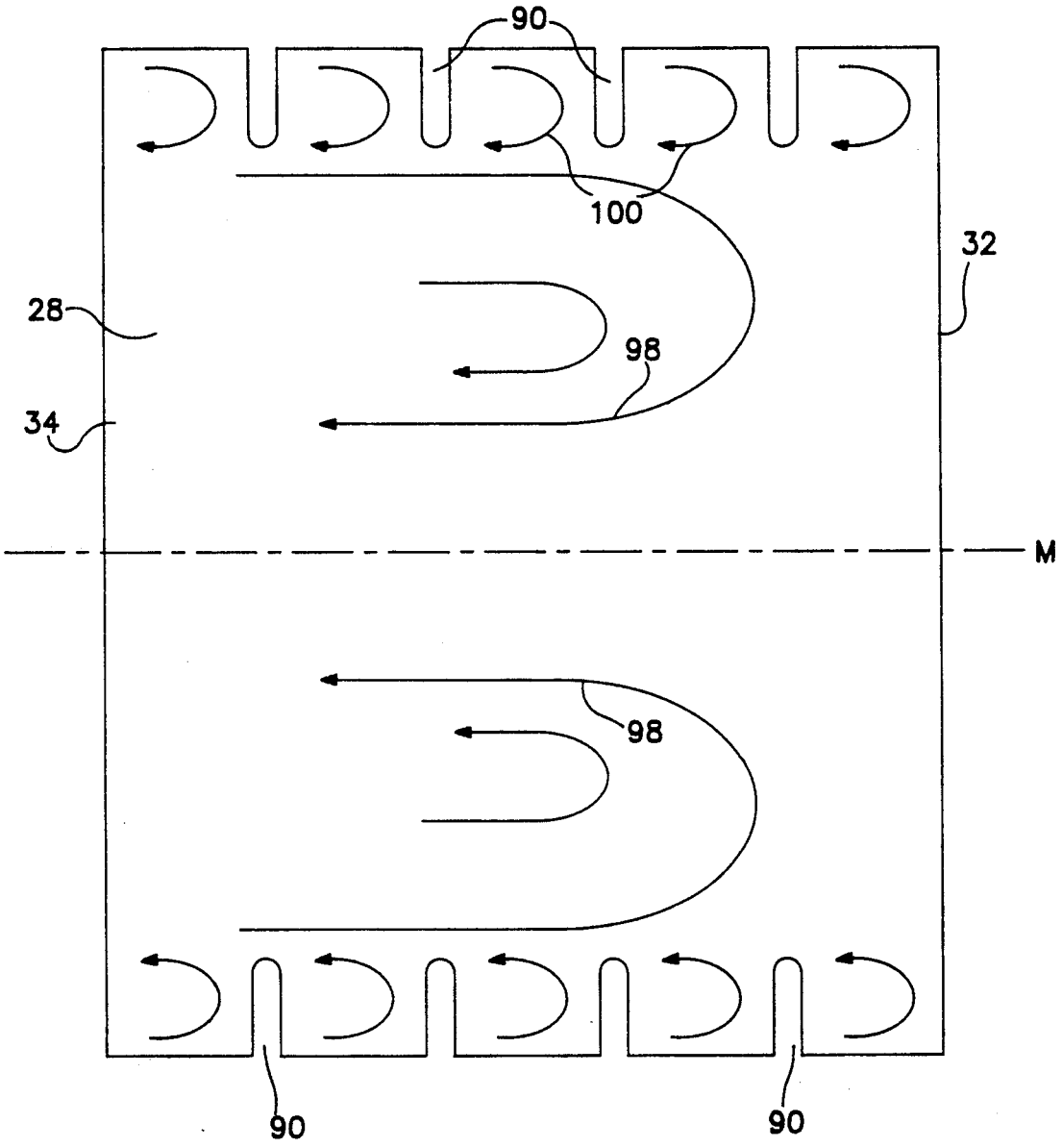

The way in which the discrete regions serve to break up and limit the eddy currents is shown schematically in FIGS. 6 and 7.

FIG. 6 illustrates the flow pattern of the eddy currents induced shell by the induction coil in a shell with insulating gap 30 but no slits. Of course, the direction of these currents alternates at the same frequency as the alternating current source used to excite coil 26, and the direction shown in the figures is that at a given instant of time. In FIGS. 6 and 7, the shell is shown "unwrapped," with ends 32 and 34 separated and the shell laid in a plane. The shell is illustrated in this manner to facilitate the explanation of the behavior of the eddy currents, but that behavior is the same whether the shell is laid flat or curved into a cylinder. Eddy currents originate in the top and bottom halves of the shell and move in a circular path toward or away from the center of the shell. Current flow at a particular instant of time is represented by arrows 94 and 96. As the currents reach the center of the shell, defined in FIG. 6 by an imaginary meridian M, both currents flow in the same direction, as shown by the heads of arrows 94 and 96. Thus, there is no cancellation effect between the voltage gradients due to the upper and lower current systems along the meridian M, and the flow of current in the center section of the shell causes the center of the shell to become extremely hot. As those skilled in the art are aware, eddy currents in the shell cause power to be dissipated in the shell, in accordance with the well-known formula $P=I^2R$, where R represents the electrical resistance of the shell. Moreover, since power is proportional to the square of the current in the shell, small currents can produce large amounts of dissipated power. The dissipated power generates heat, and causes the shell to reach extremely hot temperatures which, in turn, reduces the mechanical integrity of the vessel.

Since the power varies as the square of current, it follows that, by making small reductions in the current, power dissipation can greatly be reduced, resulting in much lower temperatures in the shell. The present invention achieves large reductions in current by creating electrically isolated regions in the shell 28. In the embodiment already described, these regions are defined by the insulating gap 30 and slots 90 in the top and bottom ends of shell 28. The shell according to this embodiment is shown, laid flat, in FIG. 7. The slots define electrically isolated regions along the top and bottom ends of shell 28 which break up induced eddy currents. In the shell of FIG. 7, instead of one large eddy current flowing in each half of the shell (as in FIG. 6), there will be induced a much smaller current (represented by arrows 98 in FIG. 7) in the electrically continuous portion of shell 28 (i.e., the portion without slits) and a plurality of very small currents (represented by arrows 100) in the portion of shell 28 which contains the slits 90. As shown in FIG. 7, an eddy current 100 induced in one of the electrically isolated regions defined by slots 90 in shell 28 is restricted to the portion of the shell located between adjacent slots. This results in small eddy currents in the top and bottom halves of shell 28. Furthermore, induced voltage gradients will tend to drive eddy currents 100 in a direction opposite to the eddy currents 98 which flow in the electrically continuous portion of shell 28. Thus, eddy currents 100 partially cancel currents 98. The end result is a dramatic reduction in the amount of induced current which flows in the shell and a concomitant reduction, according to the law of inverse squares, in the power dissipated from the shell.

Figure 8:
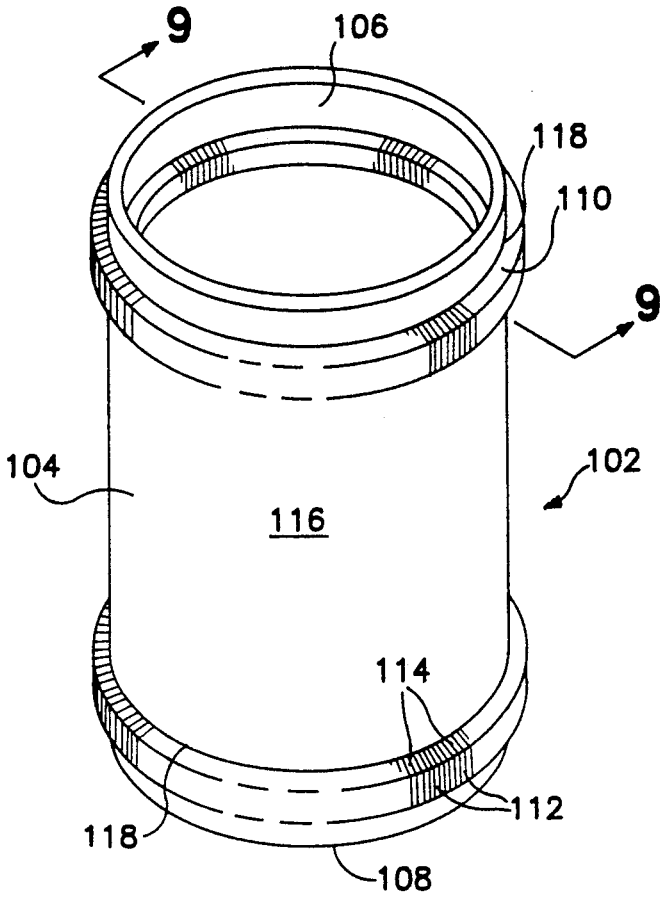
FIG. 8 is an isometric view of an alternate embodiment of an induction heating vessel according to the present invention.
Figure 9:
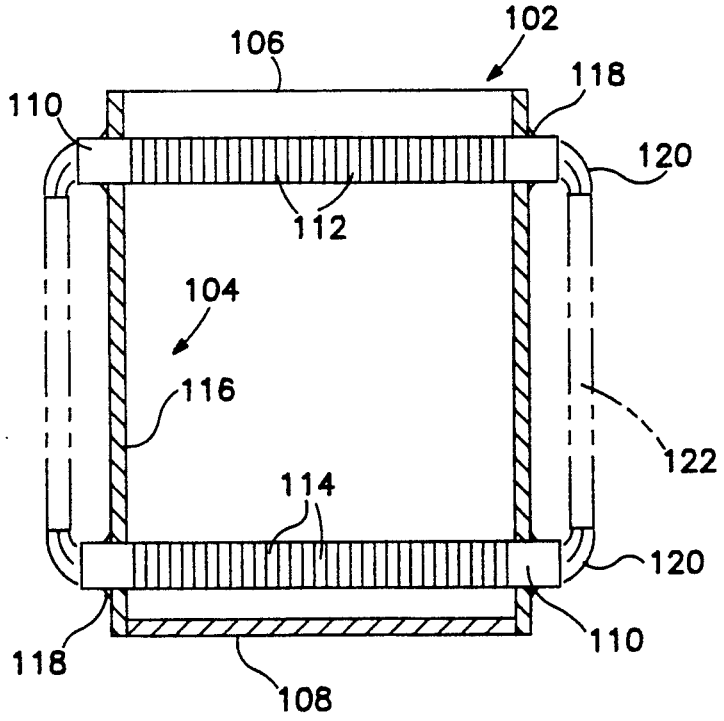
FIG. 9 is a longitudinal sectional view of the vessel of FIG. 8.

Insulating gap 30 and slots 90 are only one way of defining electrically isolated regions in shell 22. For example, physically contiguous but electrically insulated laminated strips may also be used. An embodiment of the invention using laminated strips is shown in FIGS. 8 and 9. In this embodiment, a vessel 102 comprises a crucible (not shown) surrounded by a substantially uniform cylindrical metallic shell 104 having an open top end 106 and an open bottom end 108. Bottom end 108 may either be left open or may be closed by a suitable bottom support, such as bottom 70 shown in FIG. 2. If a bottom is used, it is preferably electrically isolated from shell 104. Portions of shell 104 adjacent top end 106 and bottom end 108 are interrupted by laminated rings 110. The rings 110 are made up of thin strips 112 of metal. The strips are electrically insulated from one another by a thin layer of insulating material 114. The insulating material 114 may be any suitable insulating material The strips 112 and insulating layers 114 are laminated together by a suitable adhesive to form a physically continuous closed path of a plurality of electrically isolated regions. The laminated rings 110 are integrally joined to wall 116 of shell 104, such as by welds 118. Similar to the slots 90 in the first embodiment, the strips 112 in rings 110 break up eddy currents in the shell 104.

In either embodiment of the invention, the electrically isolated regions (defined by either the slots or the laminated rings) are substantially transparent to the flux lines from a typical induction coil. As shown in FIG. 9, which illustrates vessel 102 in place within an induction coil 122, the flux lines 120 from a typical induction coil 122 (shown in phantom) enter and leave vessel 102 near the top and bottom. By locating the electrically isolated regions where the flux lines enter and leave vessel 102, significant improvements in furnace efficiency may be realized.

Figure 10:
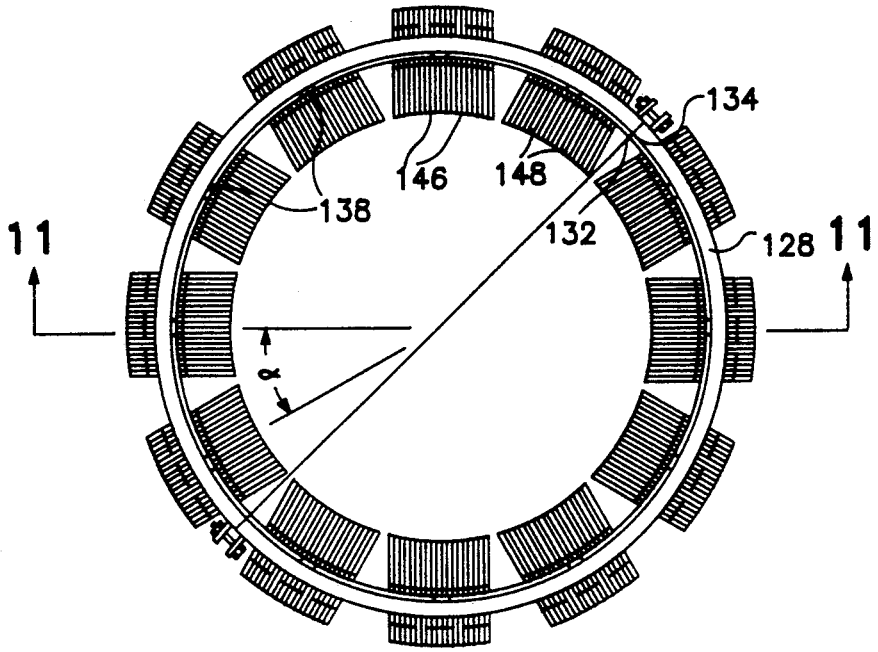
FIG. 10 is a top plan view of a variation of the alternate embodiment shown in FIGS. 8 and 9.
Figure 11:
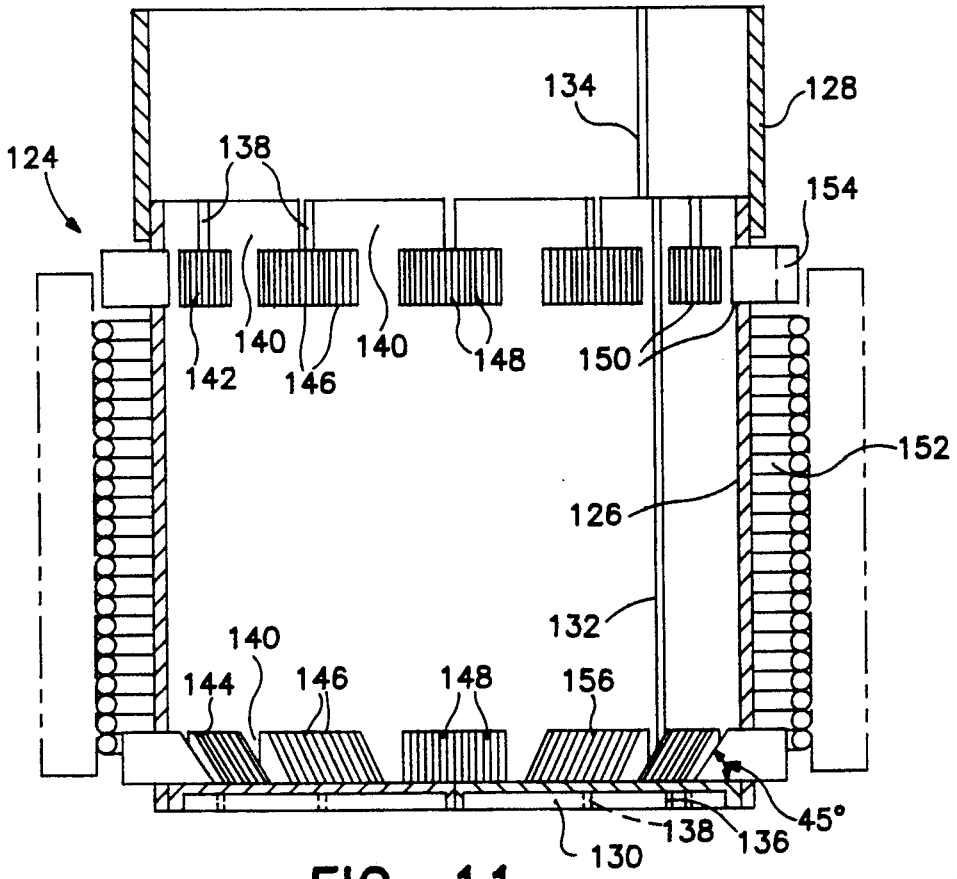
FIG. 11 is a partial sectional view of the vessel of FIG. 10, taken along the lines 11—11 in FIG. 10.

A variation of the embodiment of the vessel illustrated in FIGS. 8 and 9 is shown in FIGS. 10 and 11. In FIGS. 10 and 11, the vessel is designated generally by reference numeral 124 and comprises a substantially continuous shell 126, a collar assembly 128 and a bottom 130. As with shell 22, shell 126 has a gap 132 between its ends. Likewise, there is a gap 134 defined by halves of collar assembly 128 and a gap 136 defined by halves of bottom 130. Preferably, although not necessarily, gaps 132, 134 and 136 are all co-linear.

The variation illustrated in FIGS. 10 and 11 is, in effect, a combination of features of the embodiments illustrated in FIGS. 1 through 4 and FIGS. 8 and 9. In the variation shown in FIGS. 10 and 11, the electrically isolated regions are defined by a combination of laminated strips and slits. Thus, as in the embodiment illustrated in FIGS. 1–4, shell 126 comprises a plurality of slits 138 in the top and bottom edges of shell 126. The slits thus define electrically isolated regions 140 along the top and bottom ends of shell 126. In addition to the slits, additional electrically isolated regions are defined by laminated blocks 142 and 144 arranged circumferentially around the top and bottom ends, respectively, of shell 126. Each laminated block, like the laminated rings 110 illustrated in FIGS. 8 and 9, is made of a plurality of thin strips 146 of metal. The strips are electrically insulated from one another by a layer of insulating material 148, which may be any suitable insulating material. The strips 146 and insulating layers 148 are laminated together by a suitable adhesive to form a physically continuous block of a plurality of electrically isolated regions. The laminated blocks 142 and 144 are inserted in corresponding openings provided in shell 126 and are insulated from shell 126 by insulating strips 150. Blocks 142 and 144 may be either welded in place or secured in place by a suitable adhesive.

Blocks 142 and 144 may extend radially inward and radially outward of vessel 124 to any desired extent. Thus, blocks 142 may extend radially outwardly so as to overlap induction coil 152 or, if desired, may extend to a lesser degree to be inboard of coil 152, as illustrated by phantom line 154. Preferably, blocks 144 around the bottom end of shell 126 are limited in their radially outward extent in order to provide clearance with coil 152, so that vessel 124 may be lifted out of coil 152. Blocks 144 are also preferably, although not necessarily, provided with an angled face 156, which is preferably at an angle of 45° to the side wall of shell 126. This enables flux lines from the applied induction field from coil 152 to be directed toward the geometric center of vessel 124 to facilitate heating or stirring.

As with the strips in the embodiment illustrated in FIGS. 8 and 9, strips 146 of laminated blocks 142 and 144 are perpendicular to the side wall of shell 126. However, strips 146 need not be disposed vertically, as illustrated in FIG. 11. Instead, the strips 146 may be horizontal or at oblique angles. Moreover, blocks 142 and 144 need not be substantially rectangular in cross section. Blocks may be of any other shape, including a cylindrical roll of metal strip wound in a coil in the manner of "jelly roll".

Figure 12:
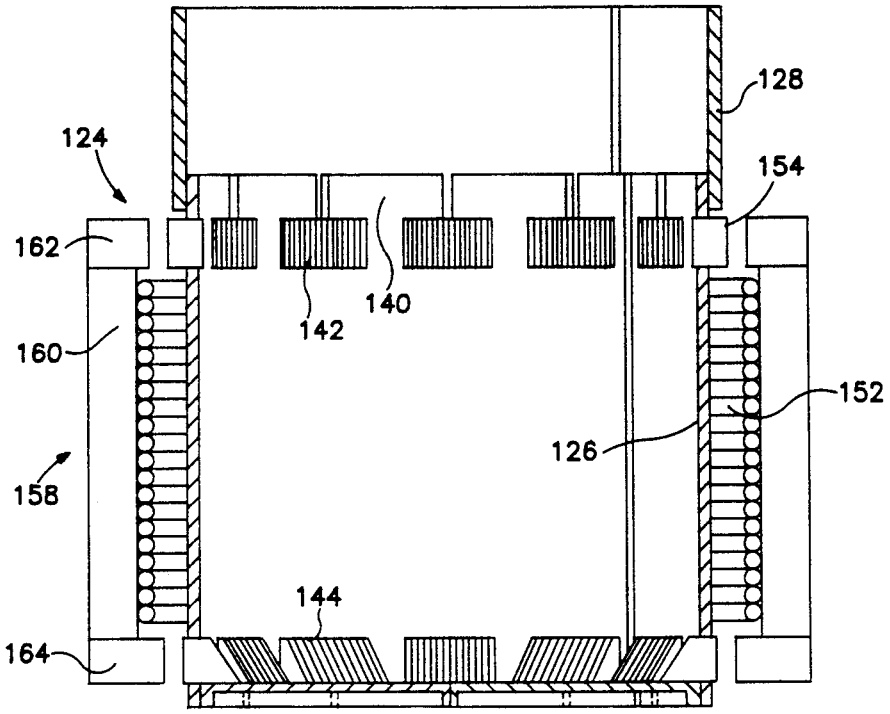
FIG. 12 is a sectional view of a variation of the vessel in FIGS. 10 and 11.

As noted above, blocks 142 may extend, if desired, radially outward so as to be inboard of coil 152, as shown by phantom line 154 in FIG. 11. FIG. 12 shows a vessel 124 in which blocks 154 are inboard of coil 152. Surrounding the circumference of coil 152 are a plurality of shunts 158. Shunts 158 are preferably made of a plurality of thin strips of metal, in the manner of laminated blocks 142 and 144. Shunts 158 may surround the entire circumference of coil 152, or may be arranged in groups, coextensive with blocks 142 and 144.

Shunts 158 comprise an upright portion 160 and top and bottom horizontal portions 162, 164, respectively. The length of upright portion 160 is approximately equal to the axial length of coil 152. Thus, top horizontal and bottom horizontal portions 160, 164 are located opposite blocks 142 and 144, respectively. Shunts 158 serve to direct the flux lines of the induction field generated by induction coil 152, so that the flux lines on the exterior of coil 152 are constrained to travel through upright portions 160 and be directed through blocks 142 and 144. Shunts 158 thus minimize stray flux and concentrate the majority of the flux lines of the induction field at the locations of blocks 142 and 144. In that way, the majority of the flux lines pass through blocks 142 and 144 to the interior of the vessel 124 without coupling substantially to shell 126. Moreover, since shunts 158 are formed of a plurality of thin laminations, as are blocks 142 and 144, very little of the induction field is lost in coupling with the shunts. Thus, shunts 158 enhance the coupling efficiency between coil 152 and vessel 124.

Figure 13:
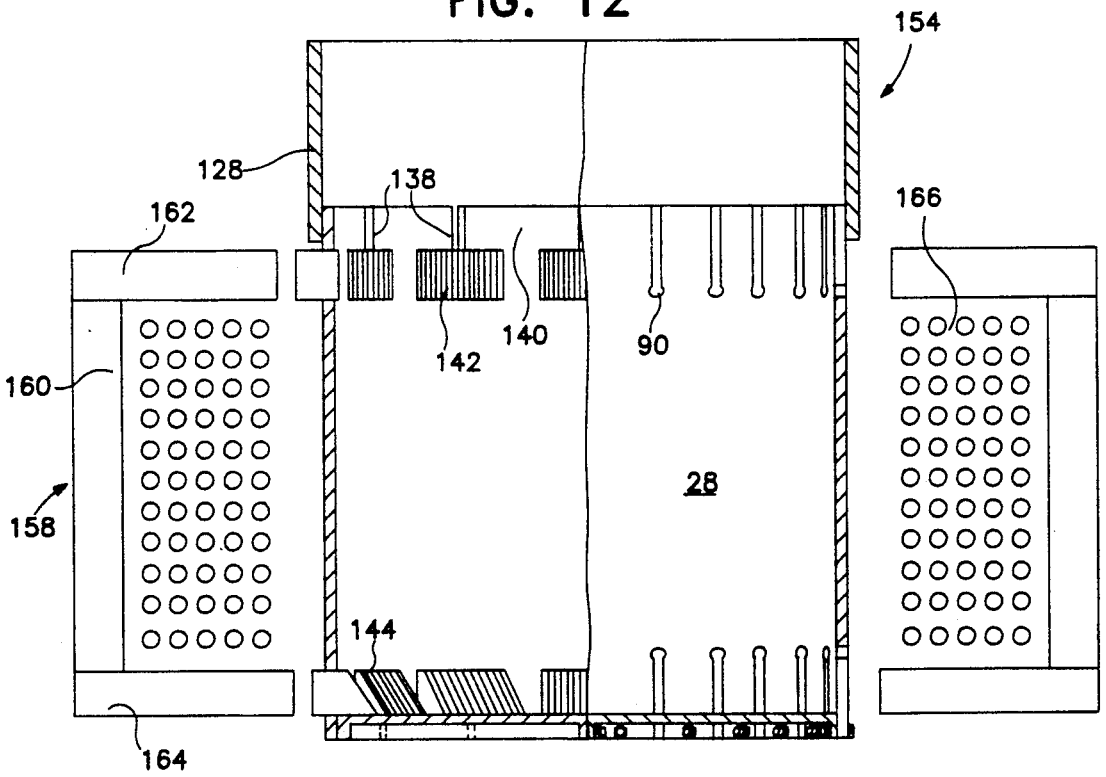
FIG. 13 is a sectional view illustrating the vessel of the invention used with a multi-layer induction coil.

As illustrated in FIG. 13, shunts 158 can be sized to accommodate a multi-layer coil 166, which comprises a plurality of concentric, radially-spaced windings, in known manner. Top and bottom horizontal portions 162 and 164 may be made shorter or longer, as desired, to accommodate any number of radially-spaced coil windings. Furthermore, as illustrated in FIG. 13, the use of shunts 158 is not limited to embodiments of the vessel which employ laminated blocks 142 and 144, but is usable also with embodiments of the vessel which employ only slits 90. Likewise, shunts 158 may be used with embodiments of the vessel which employ laminated rings, as shown in FIG. 8.

In accordance with the invention, a vessel 168 comprising a metal shell 170 having laminated blocks 172*a*, 172*b*, 172*c* and 172*d* situated in the walls of the shell can be constructed for use in a multi-layer coil assembly 174, as shown in FIG. 14. The coil assembly 174 usually, but not necessarily, comprises three coils 176, 178, 180 placed adjacent one another surrounding the vessel and located beneath the collar assembly 182. Each coil 176, 178, 180 is energized with one phase of a three phase alternating current power supply. Surrounding the outer circumference of each coil are a plurality of shunts 184. Shunts 184 are preferably constructed in the same manner as shunts 158 in FIGS. 12 and 13. That is, shunts 184 are preferably made of a plurality of thin strips of metal. Shunts 184 comprise an upright portion 184*e* and horizontal portions 184*a*, 184*b*, 184*c* and 184*d*. Each horizontal portion is substantially in registration with a corresponding laminated block 172*a*, 172*b*, 172*c* or 172*d*. The laminated blocks are similar in structure to blocks 142 and 144 in FIGS. 10 and 11. Shunts 184 serve to direct the flux lines of the induction field generated by each induction coil 176, 178, 180. The majority of the flux generated occurs on the exterior of the coils 176, 178, 180. The shunts 184 contain the flux lines and direct the flux into the interior of the vessel 168 via the laminated blocks 172*a*, 172*b*, 172*c* and 172*d* without coupling to the vessel shell. The laminated blocks 172*a*, 172*b*, 172*c* and 172*d* can be designed to be of any shape such as circular, hexagonal or rectangular as shown in FIG. 14, so long as there is enough surface area to receive the flux lines directed by the shunts 184. Moreover, since shunts 184 are formed of a plurality of lamination, as are blocks 172*a* through 172*d*, very little of the induction field is lost in coupling with the shunts.

The multi-layer coil assembly 174 and vessel 168 can be used to do multi-phase stirring in known manner. The vessel 168 allows the stirring to occur with a lower heat output, since a majority of the eddy currents produced in the vessel are broken down by the laminated blocks 172*a* through 172*d*.

It will be appreciated that the metal-jacketed vessel of the present invention offers all of the advantages of a steel-jacketed crucible, which can be realized over a wide range of temperatures and even at temperatures at which superheating of the molten metal charge occurs. Because the structure of the shell is so effective in minimizing induced eddy currents, little power is dissipated in the shell, allowing the shell to remain at temperatures significantly lower than the contents of the crucible during heating and melting. The invention thus offers a number of advantages: vessel capacity can be greatly increased; danger of "run out" is minimized; the metal shell retains its structural strength over an extremely wide temperature range; the shell remains cool relative to the contents of the crucible, which, in turn, minimizes operator discomfort and danger of injury from burns caused by hot metal.

The metal-jacketed vessel of the present invention also makes it possible to carry out metallurgical and other material treating processes on a vastly-improved economic scale. Likewise, processes not previously possible can be achieved with the vessel of the present invention.

The present invention makes it possible, for the first time, to carry out unique metallurgical processes because constant temperature, non-stratified compositions and conditions have been achieved by non-violent turbulence of the contained charge. Other processes achieve these conditions only under extreme turbulence caused by injected gases, and as a consequence require very large freeboard around the vessel and sophisticated safety controls, and suffer extreme container erosion and corrosion. The present invention makes possible the benefits of these known metallurgical reactions without these costly and expansive conditions at rates equal to or faster than achieved in the gas blown processes. This non-violent mixing allows for the use of hitherto unusable continuous temperature, pressure, and compositional sensors. The violence of the turbulence damages the sensors or renders them unreliable in the aforementioned known gas blown process. The new vessel thus makes the process controllable by accurate sensor output data to known controllers and computer networks.

It is also possible to carry out metallurgical treatment processes with virtually 100% efficiency in terms of use of equipment. Because the vessel of the present invention retains high structural strength, it is readily transportable from one location to another. This makes it possible to conveniently transport the vessel and its contents among various stations for melting, holding and treating. By using a number of vessels, it is possible to carry out a melting operation at one location while simultaneously carrying out a treating operation on an already molten charge at a treating location.

Thus, it is now possible to treat a number of metal charges in sequence on an "assembly line" basis. For example, an individual vessel is placed at a charging location, where it is charged with metal or other material to be treated. In the context of this example, it will be assumed that the vessel is charged with metal. From the charging station, the vessel is transported to a melting station which, preferably, has a high power (such as, for example, 3000 kW) melting coil. At this station, the metal is able to be melted quickly. From there, the vessel is transported to a treating station, at which is located a low power (such as, for example, 500 kW) induction coil with a power output sufficient to keep the already-molten metal in the liquid state. At the treating station, elements such as carbon and silicon can be added to the melt, or the melt can be treated with any number of commonly-used gases such as argon, oxygen, carbon dioxide and nitrogen, for treating and/or refining. From the treating station, the vessel is then taken to a location for further processing, such as casting.

The high structural strength of the vessel provided by metal shell 192 permits the vessel to be heated at a heating station prior to pouring and then transferred to the pouring station. A modified vessel according to the invention can be used as a bottom pouring tundish to fill molds in a foundry as shown in FIGS. 15 through 17.

One of the problems associated with pouring the molten metal into the molds is that the metal tends to solidify as it comes in contact with cold surfaces, causing inconsistencies in the melt. The inconsistencies can result in lower quality castings. Filling a cool tundish with molten metal as in normal casting processes results in a melt which is cooler at the inner surfaces of the vessel and hottest at the center of the melt. Meanwhile, as the metal is poured into each mold, the metal at the surface of the vessel is cooling. This results in inconsistencies from casting to casting. By preheating the vessel 186 to the temperature of the molten metal prior to placing the molten metal in the vessel 186, and maintaining that temperature while pouring the molten metal into the molds in the pouring station, virtually all inconsistencies associated with the molten metal inside the vessel can be eliminated and an environment in which the molten metal is maintained at a constant temperature is provided.

The present invention provides a vessel that makes this possible. The vessel 186 of FIGS. 15–17 is equipped with a nozzle 188 situated in the bottom of the vessel 186. The nozzle 188 is preferably funnel-shaped but can be any suitable shape such as cylindrical or square and is particularly suited for use in a bottom pouring molten metal vessel. The nozzle 188 can be made of a thermally conductive material which can retain its mechanical strength at the melting temperature of the molten metal or any suitable refractory material which can retain its mechanical strength in contact with the molten metal. The nozzle 188 extends partially into the interior 190 of the vessel such that the portions of the nozzle 188 within the interior 190 of the vessel 188 continuously maintain thermal contact with the molten metal within the vessel 188. The nozzle 188 can be insulated in known manner from thermal contact with the outer shell 192 of the vessel 188 to prevent heat from being drawn from the nozzle 188. The extension of the nozzle 188 into thermal contact with the molten metal allows all points on the nozzle 188 to remain at very nearly the same temperature whether molten metal is or is not being poured through the nozzle 188. By maintaining the temperature of the nozzle 188 at very nearly the same temperature as the molten metal, slag formation on the nozzle's inner surface is minimized, thereby greatly reducing clogging problems.

Figure 15:
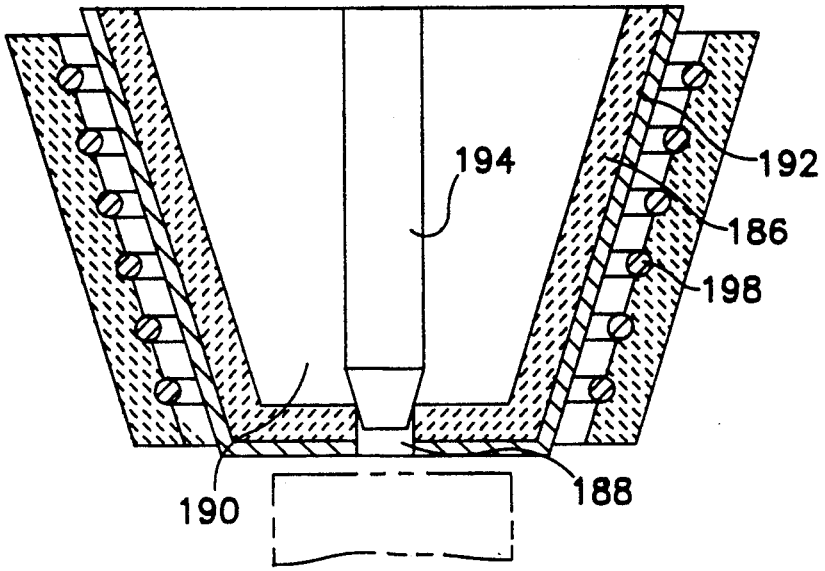
FIG. 15 is a sectional view illustrating an alternate embodiment of an induction heating vessel according to the present invention.
Figure 16:
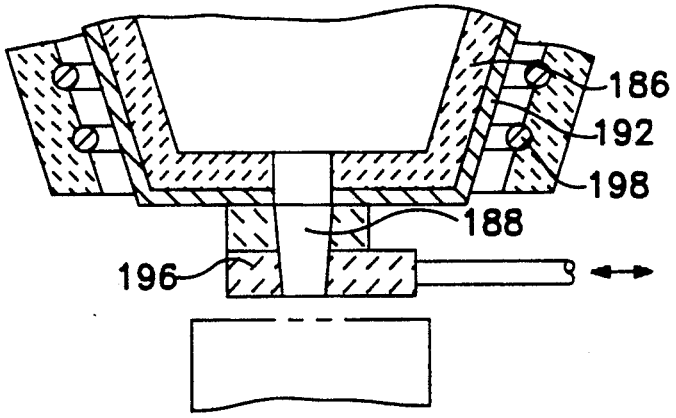
FIG. 16 is a partial sectional view of a variation of the induction heating vessel in FIG. 15.

In conjunction with the nozzle 188 is a stopper means such as a stopper rod 194 or slide gate mechanism 196 as shown in FIGS. 15 and 16 to control the flow rate of the molten metal through the nozzle 188. The amount of molten metal which flows through the nozzle 188 is directly proportional to the amount by which the stopper rod 194 is raised away from the nozzle 188 or the slide gate 196 is pulled away from the opening of the nozzle 188. Use of this pouring arrangement helps to control the flow rate of molten metal through the pouring nozzle 188 and to maintain the temperature of the nozzle 188 during non-pouring periods such that the slag formation and metal accretion around the inner surface of the nozzle is minimized.

Figure 17A:
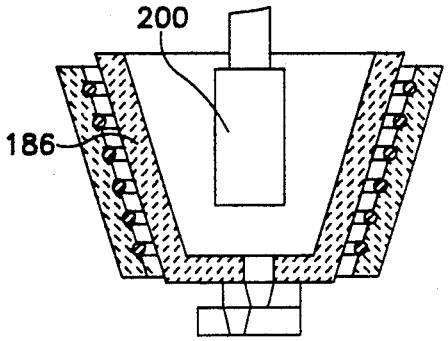
FIGS. 17A-17D illustrate the induction heating vessel of the present invention used in a refining process.
Figure 17B:
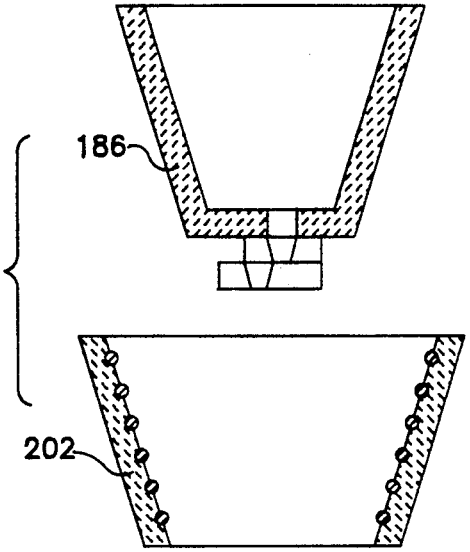
Figure 17C:
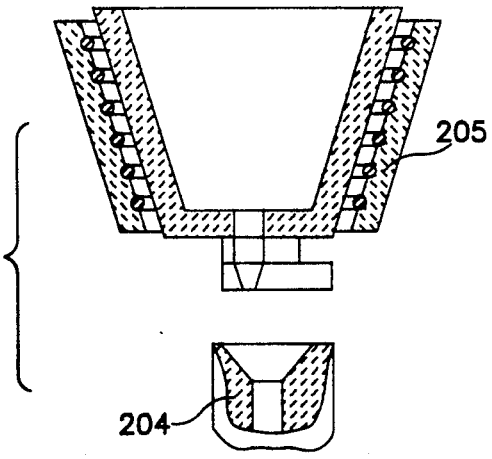
Figure 17D:
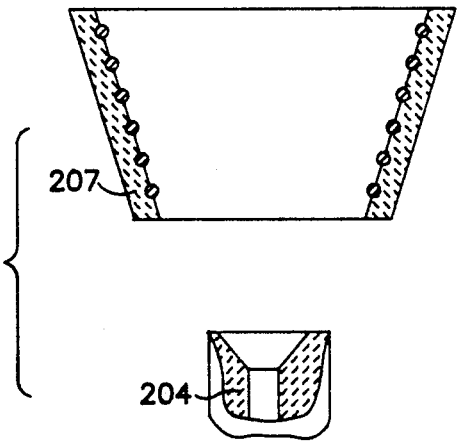

For preheating, the vessel 186 is situated in a preheating station as shown in FIG. 17A and an enlarged view in FIG. 18. The vessel 186 is placed in an induction coil 198 and a susceptor block 200 is lowered into the vessel 186. The susceptor block 200 can be made of any suitable refractory material such as graphite or silicon carbide which can be heated to the temperature of the molten metal without losing mechanical integrity, and can, if desired, be coated with a layer of silicon. The coil 198 is energized and the magnetic flux generated by the coil 198 induces a current in the susceptor block 200 by the magnetic flux generated by the induction coil 198, which heats us susceptor block 200. As the current heats up the susceptor block 200, the temperature of the vessel 186 is raised by radiant and convective heating from susceptor block 200. Once the vessel 186 reaches the desired temperature, i.e., approximately the temperature of the molten metal, the susceptor block 200 is removed from the vessel 186 and the vessel 186 is transferred to the pouring station B as shown in FIG. 17. The strength provided by shell 192 makes it possible to easily transport vessel 186. At filling station B, the heated vessel 186 is placed in a second coil 202 while vessel 186 is filled with molten metal from a melting furnace. The coil 202 remains energized throughout the filling process to maintain the vessel 186 and the molten metal at the desired temperature while the vessel is being filled. After filling, vessel 186 is moved to one or more mold filling stations C and D where metal is poured into molds 204. As in conventional pouring stations, the molds 204 are passed under the pouring nozzle 188 and each mold 204 is filled with the molten metal. Additional coils 205 and 207 are provided at mold filling stations C and D to keep the molten metal in vessel 186 at the desired pouring temperature.

Because the vessel 186 can be readily transported from place to place, it makes it possible to maintain the molten metal in vessel 186 at the proper temperature at all stations, making it unnecessary to superheat the metal. The invention permits molten metal to be poured into a heated vessel rather than a cold vessel which prevents the metal from cooling and altering the consistency of the melt which would lower the quality of the ingot. The process made possible by a preheated vessel according to the invention allows for a substantial decrease in the power needed to carry out the process.

Because the vessel of the present invention can be easily and safely moved from location to location, all of the preceding steps can be carried out simultaneously. Thus, while one vessel is at the heating station, another can be at a melting station, and another at a filling station, while a vessel containing already-treated metal is at a casting station. The vessel of the present invention makes it possible to greatly increase equipment usage, minimize equipment "dead time," and speed up throughput.

Figure 20:
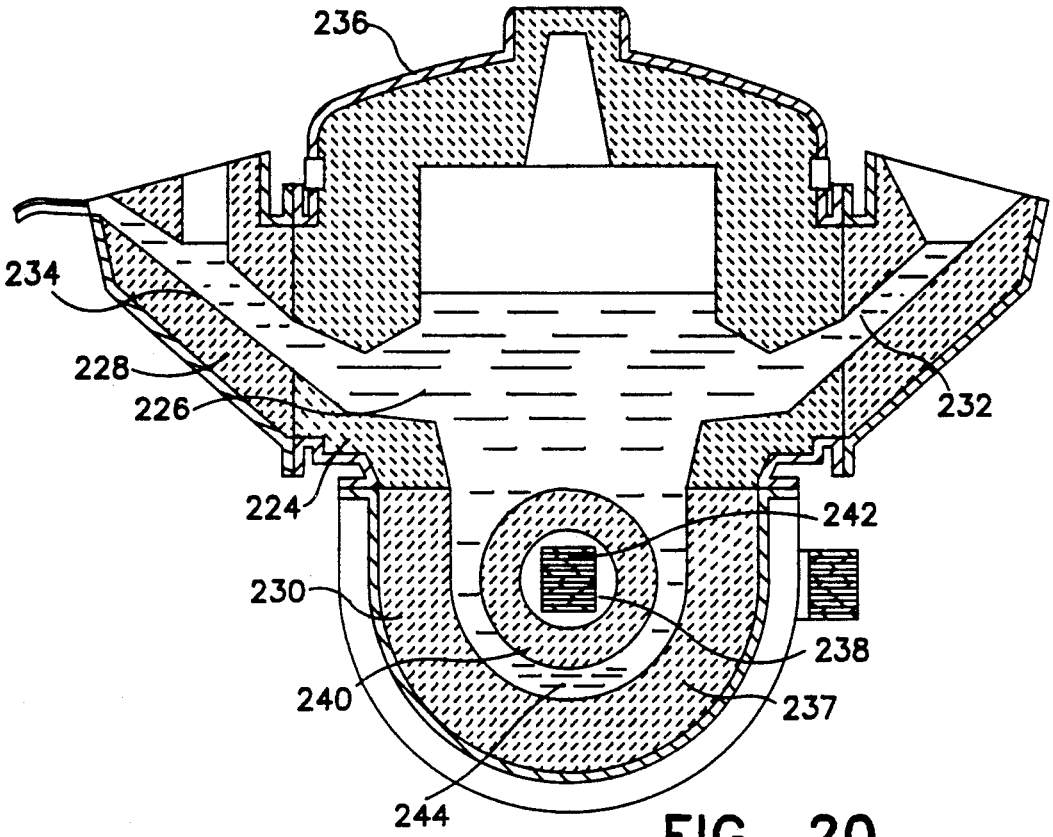
FIG. 20 illustrates a prior art positive pressurized pouring vessel.

Other processes which can now be improved by the vessel of the invention are those which use a pressurized pouring ladle. An example of a prior art pressurized pouring ladle 222 is illustrated in FIG. 20. The ladle 222 has thick walls 224 made of a suitable refractory material which can sustain the temperature of the molten metal 226 contained in the ladle 222. The ladle 222 comprises an upper portion 228 and a lower portion 230. The upper portion 228 has an upwardly angled inlet spout 232 positioned on one side of the ladle 222 which receives molten metal from a melting vessel (not shown). On the opposite side of the ladle 222 is an upwardly angled outlet spout 234 which has a narrower channel than the inlet spout 232. A lid 236 is hingedly connected to the upper portion 228 of the furnace. The lid contains a positive pressure means (not shown) which can selectively apply a positive pressure gas to the molten metal 226. The positive pressurized gas is used to meter the amount of molten metal which exits from the outlet spout 266 and into the molds (not shown). Each time pressurized gas is admitted into the furnace 248, a predetermined amount of molten metal 258 is forced out through spout 234.

The outer wall 237 of the lower portion 230 of the ladle 222 is hemispherical and has a cylindrical bore 238 positioned at its center surrounded by a wall 240 of refractory material. A channel 244 is formed between the outer wall 237 and inner wall 240 of the lower portion 230 of the furnace 222. Inside the bore 238 is one leg of a rectangular transformer core 242. The transformer core 242 is made up of a plurality of thin laminations which are stacked on top of one another. A coil (not shown) is wound around core 242 to inductively heat molten metal in ladle 222. The channel 244 acts as the secondary of the transformer whose primary comprises core 242, so that energy is inductively coupled to the molten metal 226 in the ladle 222. One of the major problems with this type of prior art ladle 222 is that there is a tendency for the channel 244 to become clogged with molten metal.

Figure 21:
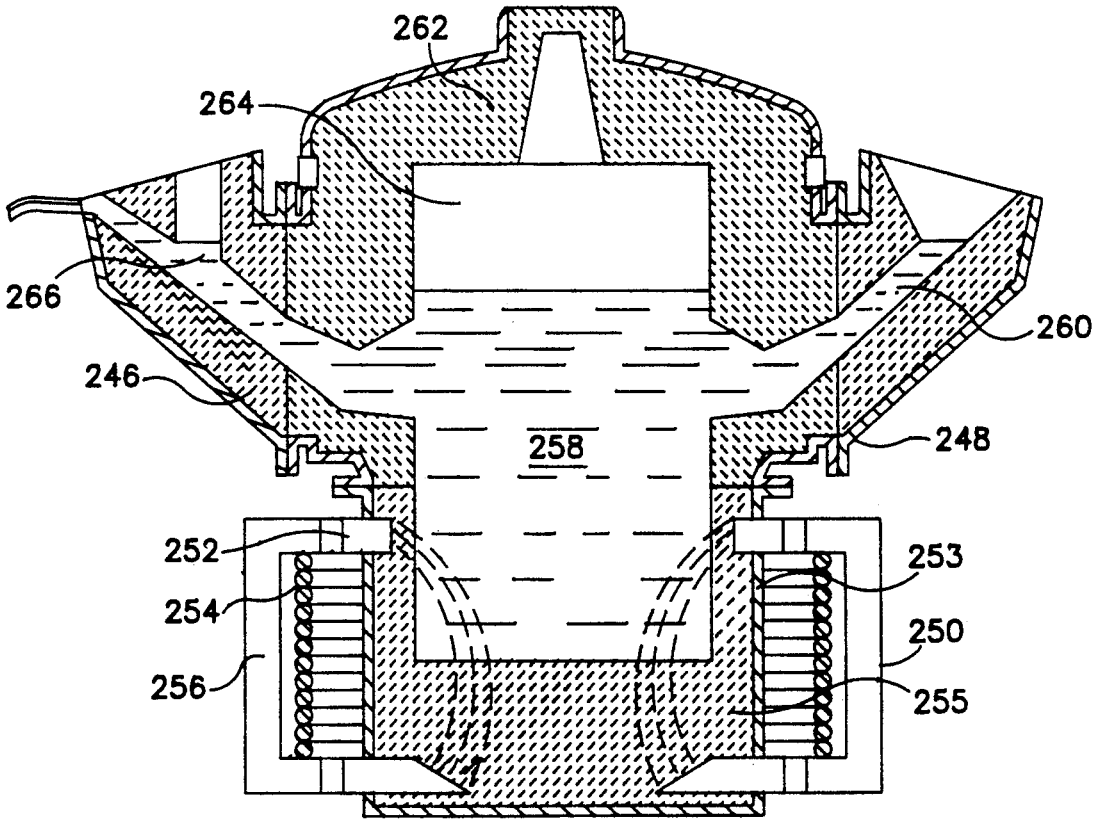
FIG. 21 illustrates an improved positive pressurized pouring furnace according to the present invention.

By using a pressure ladle having eddy current limiting means in its side walls according to the invention, as illustrated in FIG. 21, there is no longer a need for channel 244 in the ladle. The upper portion 246 of the ladle 248 is essentially the same as the prior art ladle 222. The lower portion 250 of the ladle 248 has eddy current limiting means 252, such as laminated blocks similar to those in FIG. 11 or any of the embodiments previously described, located in the shell 253 surrounding the refractory material 255. To heat metal in the ladle 248, the ladle 248 is placed in an induction coil 254 which is surrounded on its outer surface by shunts 256 similar to those in FIG. 11. The shunts 256 are positioned so that they are in registration with the eddy current limiting means.

During operation, molten metal 258 is poured into the inlet spout 260 of the ladle 248 from a melting station (not shown). The induction coil 254 is energized so that a magnetic flux is generated to inductively heat the metal 258 and maintain it in its molten state. The shunts 256 guide the flux into the interior of ladle 248 through the eddy current limiting means 252 which reduce the eddy currents induced in the shell 253 as previously described. By using the eddy current limiting means 252 instead of a channel there is no longer a problem with clogging and the ladle 248 has higher mechanical strength and it is more efficiently heated.

The present invention also makes it possible to treat materials in a transportable controlled environment. For example, in manufacturing certain types of composite materials such as carbon/carbon and composite ceramics, it is usual to place a graphite crucible, or susceptor, within an induction coil located inside a sealed environmental chamber. This process conventionally starts with a cold chamber, into which a graphite susceptor containing a charge of material is placed. After the charged susceptor is placed in the coil within the chamber, the chamber must be sealed and the atmosphere evacuated, and the charge in the susceptor brought up to treatment temperature by the induction coil. Once at treatment temperature, the material can be subjected to treatment gases or a vacuum, as desired. After treatment is complete, the charge must be permitted to cool before the susceptor can be removed from the chamber.

The conventional process is quite time consuming and could take 24 hours from start to finish. However, with the vessel of the present invention, it is possible to seal the vessel itself, so that the vessel in effect becomes the environmental chamber. This permits treating in a controlled environment to be carried out using a conventional induction coil and does not require a separate environmental chamber. Thus, the vessel of the present invention can be fitted in any convenient manner with an appropriate cover and fittings for sealing and evacuating the interior of the vessel after it is charged and for admitting treating gases. The sealed vessel can then be placed in a conventional induction coil for heating.

An additional vacuum melting process for making super alloys can now be accomplished with the new vessel as illustrated in FIG. 19. The vessel 206 can have a metal shell 207 having any of the eddy current limiting means previously described, such as laminated blocks 208 as shown in FIG. 19. The laminated blocks function in the same way as blocks 140 and 142 in FIGS. 10 and 11. The vessel 206 is placed in an induction coil 210 mounted inside an air tight vacuum chamber 212. Between the inner surfaces of the walls of chamber 212 and the coil 210 are shunts 214. Metal can be directly transferred to the vessel 206 from a melting furnace (not shown) located inside chamber 212 or by pouring the metal from the melting furnace through a launder connecting a mold vacuum tank to the melt vacuum tank (not shown).

In order to treat the metal, a treating gas, such as argon, may be pumped at atmospheric pressure into the tank 212 exterior to the vessel 206 via a tube 216 connected to a conventional pump unit (not shown). The treating gas removes any inclusions in the metal, thus producing higher quality ingots.

The induction coil 210 is energized to maintain the metal in a molten state. A conventional vacuum pump indicated by arrow 218 is attached to the open end 220 of the vessel 206. The vacuum causes a substantial pressure differential to exist between the interior of the tank 212 which is at atmospheric pressure and the inside of the vessel 206.

The vessel is made of a refractory material which is inherently porous, and the eddy current limiting means, such as the blocks 208, has minute gaps between its alternating strips of conductive and non-conductive material. The pressure differential will draw the argon through the gaps in the laminated blocks 208 and the porous refractory. The treating gas is thus drawn through the molten metal.

As with the process described previously, this process permits great savings in cost and improvements in throughput. While one vessel is being charged, another can be heated, while a third can be unloaded. In addition, it is no longer necessary to wait for an environmental chamber to heat up and cool down before the vessel can be moved. Instead, the vessel can simply be placed in an induction coil and, after treatment is completed, be removed immediately and allowed to cool. As soon as one vessel is removed from the coil, another vessel, already charged, can be placed in the coil. Thus, significant improvements in throughput and equipment utilization can be realized.

The present invention may be embodied in other specific forms without departing from the spirit or essential attributes thereof and, accordingly, reference should be made to the appended claims, rather than to the foregoing specification, as indicating the scope of the invention.

We claim:

1. A bottom pouring induction heating vessel for use in induction heating apparatus wherein said vessel is generally surrounded by an induction coil, said vessel comprising:

holding means for containing a molten metal to be heated, having a substantially continuous side wall and a bottom portion having outlet means located in said bottom portion;

a substantially continuous metallic shell surrounding said side wall and said bottom portion of said holding means, said continuous metallic shell comprising a metallic wall between said holding means and said coil;

stopper means for selectably controlling flow of said molten metal through said outlet means; and current limiting means integral with the shell for limiting induced electrical currents in the shell.

2. A bottom pouring induction heating vessel according to claim 1, wherein said holding means comprises a refractory material and said current limiting means comprises thin strips of alternating conductive and non-conductive material.

3. A bottom pouring induction heating vessel according to claim 1, wherein said stopper means is a stopper rod.

4. A bottom pouring induction heating vessel according to claim 1, wherein said stopper means is a slide gate.

5. A bottom pouring induction heating vessel according to claim 1, wherein said outlet means is a nozzle.

6. A bottom pouring induction heating vessel according to claim 1, wherein said vessel is operatively associated with an induction coil.

7. An induction heating apparatus and vessel for use in multi-phase heating, comprising:

holding means having an interior for containing a material to be heated, said holding means having a substantially continuous side wall and a bottom portion;

a plurality of coils adjacent one another, said coils surrounding said holding means and generating a multi-phase magnetic induction field;

a substantially continuous metallic shell surrounding said side wall and said bottom portion of said holding means, said continuous metallic shell comprising a metallic wall between said holding means and said plurality of coils;

current limiting means located in said shell for limiting induced electrical currents in said shell; and shunt means adjacent said coils for directing flow of flux through said current limiting means into the interior of said holding means.

8. Induction vessel according to claim 7, wherein said holding means is made from a refractory material.

9. Induction vessel according to claim 7, wherein said plurality of coils comprises three coils, each coil being 120° out of phase with adjacent coil.

10. An induction heating apparatus and vessel for use in multi-phase heating, comprising:

holding means having an interior for containing a material to be heated, having a substantially continuous side wall and bottom;

a plurality of coils adjacent one another, said coils surrounding said holding means and generating a multi-phase magnetic induction field;

a substantially continuous metallic shell surrounding the side wall and bottom of said holding means, said continuous metallic shell being formed by a metallic wall between said holding means and said coils;

current limiting means located in said shell for limiting induced electrical currents in said shell wherein said current limiting means comprises laminated blocks made of alternating layers of conductive and non-conductive material; and shunt means adjacent said coils for directing flow of flux through said current limiting means into the interior of said holding means.

11. Induction vessel according to claim 10, wherein said current limiting means are in registration with said shunt means.

12. A pressurized pouring ladle for use in induction heating and melting apparatus wherein said ladle is at least partially surrounded by an induction coil, said ladle comprising:

a crucible having an upper portion and a lower portion;

said upper portion having a substantially continuous side wall and an upwardly angled inlet spout located on a first portion of said wall and an upwardly angled outlet spout located on a second portion of said wall opposite to said first portion;

said lower portion of said crucible being surrounded by a substantially continuous metallic shell, said continuous metallic shell being formed by a metallic wall between said crucible and said induction coil; and current limiting means located on said shell.

* * * * *